US007536810B2

(12) United States Patent
Jau et al.

(10) Patent No.: US 7,536,810 B2
(45) Date of Patent: May 26, 2009

(54) SHOE ATTACHMENT ASSEMBLY FOR VARIOUS CYCLES

(76) Inventors: Guo Jr Jau, P.O. Box. 63-99, Taichung (TW) 406; Jia Bin Chen, P.O. Box 63-99, Taichung (TW) 406

( * ) Notice: Subject to any disclaimer, the term of this patent is extended or adjusted under 35 U.S.C. 154(b) by 313 days.

(21) Appl. No.: 11/653,733

(22) Filed: Jan. 15, 2007

(65) Prior Publication Data

US 2007/0113428 A1 May 24, 2007

Related U.S. Application Data

(62) Division of application No. 10/811,335, filed on Mar. 26, 2004, now abandoned.

(51) Int. Cl.
*A43B 5/00* (2006.01)

(52) U.S. Cl. ..... 36/131; 36/59 R; 36/67 A

(58) Field of Classification Search ..... 36/131, 36/134, 59 R, 62, 67 R, 67 A
See application file for complete search history.

(56) References Cited

U.S. PATENT DOCUMENTS 383,133 A * 5/1888 Kingston et al. ..... 36/66
550,409 A * 11/1895 Hanson ..... 74/594.6
1,232,896 A * 7/1917 Clifford ..... 36/61
4,876,808 A * 10/1989 Hsieh ..... 36/131
4,898,063 A * 2/1990 Sampson ..... 74/594.6
5,079,968 A * 1/1992 Starner ..... 74/594.6
5,682,689 A * 11/1997 Walker et al. ..... 36/134
5,685,093 A * 11/1997 Lin ..... 36/131
6,089,122 A * 7/2000 Nagano ..... 74/594.6
6,189,242 B1 * 2/2001 Lin ..... 36/131
6,260,291 B1 * 7/2001 Farys ..... 36/131
6,490,948 B2 * 12/2002 Tanaka ..... 74/594
6,754,984 B2 * 6/2004 Schaudt et al. ..... 36/128

* cited by examiner

*Primary Examiner*—Jila M Mohandesi

(57) ABSTRACT

A shoe includes a shoe sole having one or more slots to detachably attach a cleat member which may be attached to cycle pedal. A plate is selectively attached to the shoe sole and has an opening to receive the cleat member, and to allow the cleat member to extend out of the plate, and to be attached to the cycle pedal. The plate includes one or more bulges or pegs to engage into the shoe sole and to anchor the plate to the shoe sole. One or more cleat elements may be detachably attached to the shoe sole, and partially received in depressions of the shoe sole, to anchor the cleat element to the shoe sole.

13 Claims, 10 Drawing Sheets

SHOE ATTACHMENT ASSEMBLY FOR VARIOUS CYCLES

CROSS REFERENCE

The present Application is a Divisional Application based on U.S. patent application Ser. No. 10/811,335 filed Mar. 26, 2004 which is to be abandoned.

BACKGROUND OF THE INVENTION

1. Field of the Invention

The present invention relates to a shoe attachment assembly, and more particularly to a shoe attachment assembly for attaching to various cycles.

2. Description of the Prior Art

Various kinds of typical shoes have been developed and comprise one or more attachments for detachably or changeably attaching or securing to bottom thereof.

For example, U.S. Pat. No. 383,133 to Kingston et al. and U.S. Pat. No. 1,232,896 to Clifford disclose two of the typical shoes each having one or more attachments, such as sole plates and spikes, anti-slipping devices, or the like for detachably or changeably attaching or securing to bottom thereof.

However, the attachment or the securing of the sole plates and spikes, or the anti-slipping devices to the bottom of the typical shoes may be used to prevent the shoe soles from wearing while walking on pavements and floors, but may not be used to attach to cycles.

U.S. Pat. No. 550,409 to Hanson, and U.S. Pat. No. 4,876,808 to Hsieh disclose two further typical shoes each having an attachment detachably or changeably attached or secured to bottom thereof, for attaching to various cycles.

However, the attachment allows the typical shoes to be attached to cycles only, but may not be used to prevent the shoe soles from wearing while walking on pavements and floors, such that the attachment is good for being attached to sports cycles or bikes only, but may not be used for being attached to mountain cycles or bikes.

For mountain cycles or bikes, in addition to riding the cycles or bikes, the riders may have a good chance to climb the mountain together with the cycles or bikes. However, the typical shoes do not have suitable attachments for detachably or changeably attaching or securing to bottom thereof and to allow the typical shoes to be used for walking or for mountain climbing purposes, and simultaneously to allow the typical shoes to be attached to mountain cycles or bikes.

The present invention has arisen to mitigate and/or obviate the afore-described disadvantages of the conventional shoe attachment assemblies.

SUMMARY OF THE INVENTION

The primary objective of the present invention is to provide a shoe attachment assembly including a shoe attachment assembly for attaching to various cycles, including such as mountain cycles or bikes, or sports cycles or bikes, or the like.

In accordance with one aspect of the invention, there is provided a shoe comprising a shoe sole including at least one slot formed therein, a cleat member detachably attached to the slot of the shoe sole, for attaching to cycle pedal, and a plate selectively attached to the shoe sole, and including an opening formed therein to receive the cleat member, and to allow the cleat member to extend out of the plate, and to be attached to the cycle pedal.

The plate includes at least one projection extended downwardly therefrom for preventing the shoe sole from wearing while walking on pavements and floors. The shoe sole further includes at least one orifice formed therein, the plate includes at least one bulge extended therefrom and engageable into the orifice of the shoe sole to anchor the plate to the shoe sole. One or more spikes may further be provided to secure the plate to the shoe sole.

One or more cleat elements may further be provided and detachably attached to the shoe sole. The shoe sole includes at least one depression formed therein and defined by a peripheral fence, to partially receive the cleat element, and to anchor the cleat element to the shoe sole.

The shoe sole includes a bulge extended into the depression thereof, and the cleat element includes a cavity formed therein, to receive the bulge of the shoe sole, and to further anchor the cleat element to the shoe sole. The shoe sole includes at least one aperture formed therein, and the cleat element includes at least one peg extended therefrom, to engage into the aperture of the shoe sole, and to further anchor the cleat element to the shoe sole.

The plate includes at least one extension extended therefrom, the cleat element is selectively attachable to the extension of the plate. The extension of the plate includes at least one depression formed therein and defined by a peripheral fence, to partially receive the cleat element, and to anchor the cleat element to the shoe sole.

The extension of the plate includes a bulge extended into the depression thereof, and the cleat element includes a cavity formed therein, to receive the bulge of the extension of the plate, and to anchor the cleat element to the plate.

The shoe sole includes an outsole, and insole, and a cushioning device disposed between the outsole and the insole of the shoe sole. The outsole of the shoe sole includes a chamber formed therein to receive the cushioning device. The insole includes an opening formed therein to engage the cushioning device into the chamber of the outsole. The insole includes a cover to enclose the opening of the insole.

The shoe sole further includes at least one nut engaged therein, and at least one fastener or spike may be engaged through the plate and threaded to the nut.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
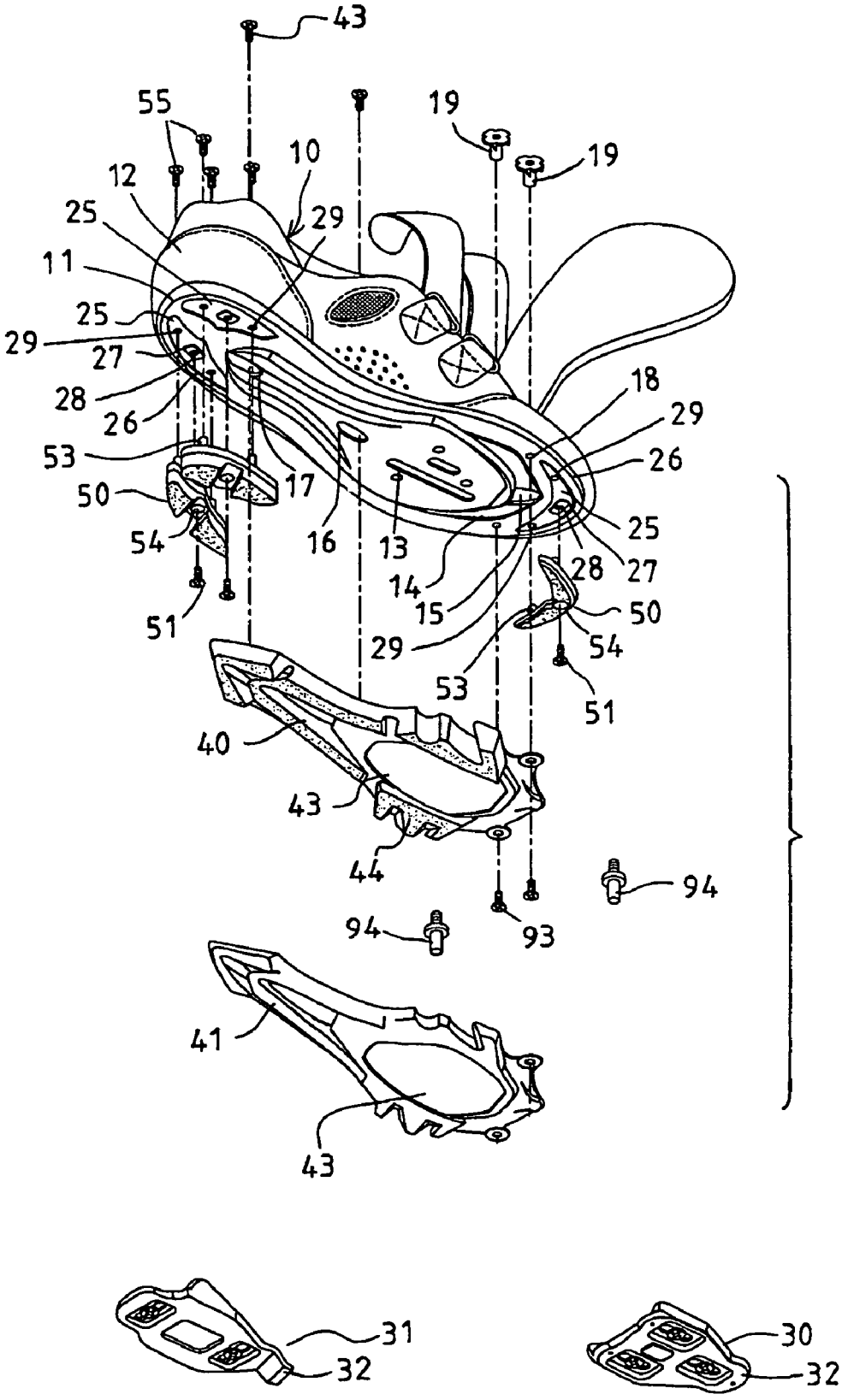
FIG. 1 is an exploded view of a shoe attachment assembly in accordance with the present invention.
Figure 2:
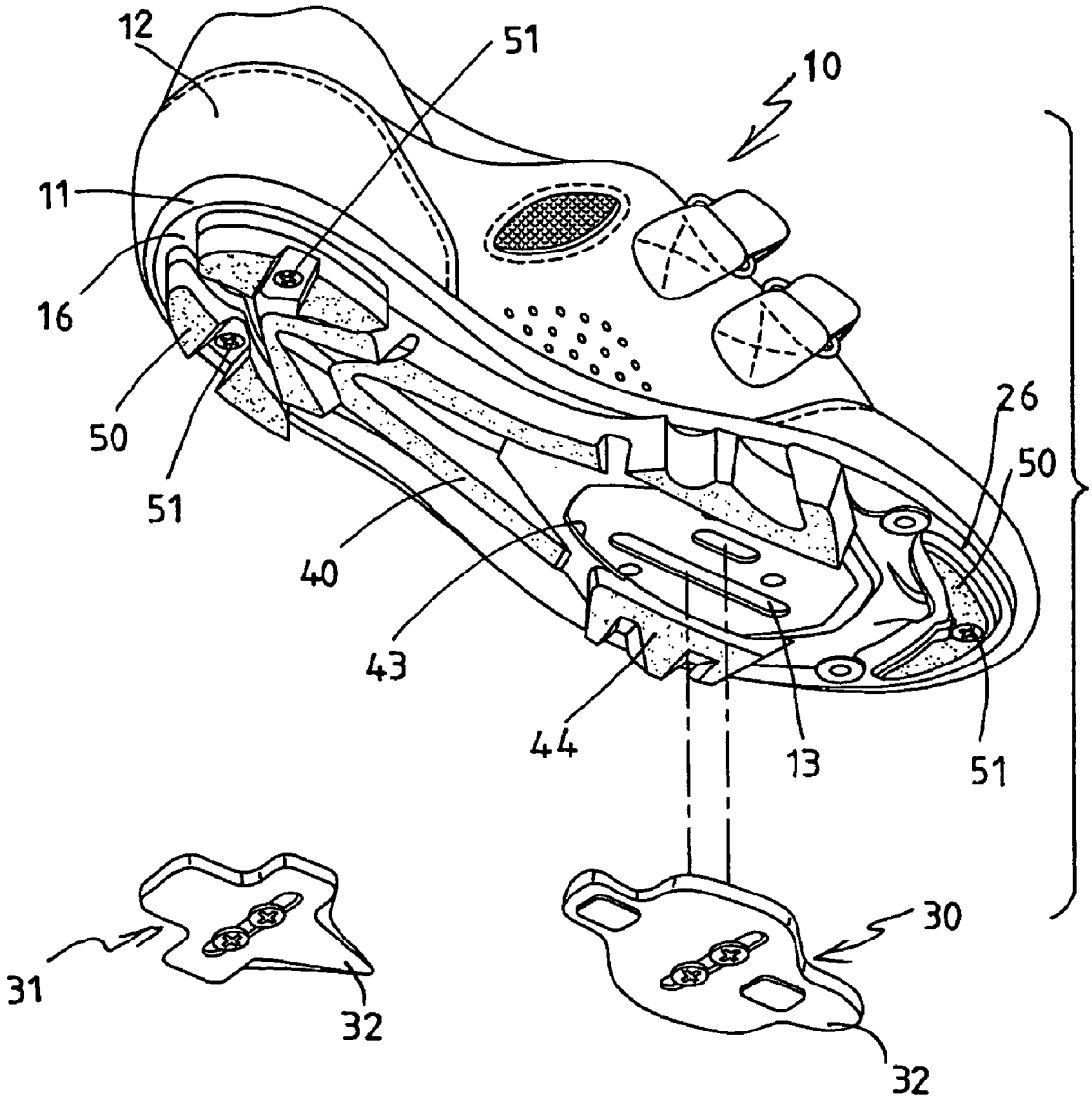
FIGS. 2, 3 are partial exploded views illustrating the operation of the shoe attachment assembly.
Figure 3:
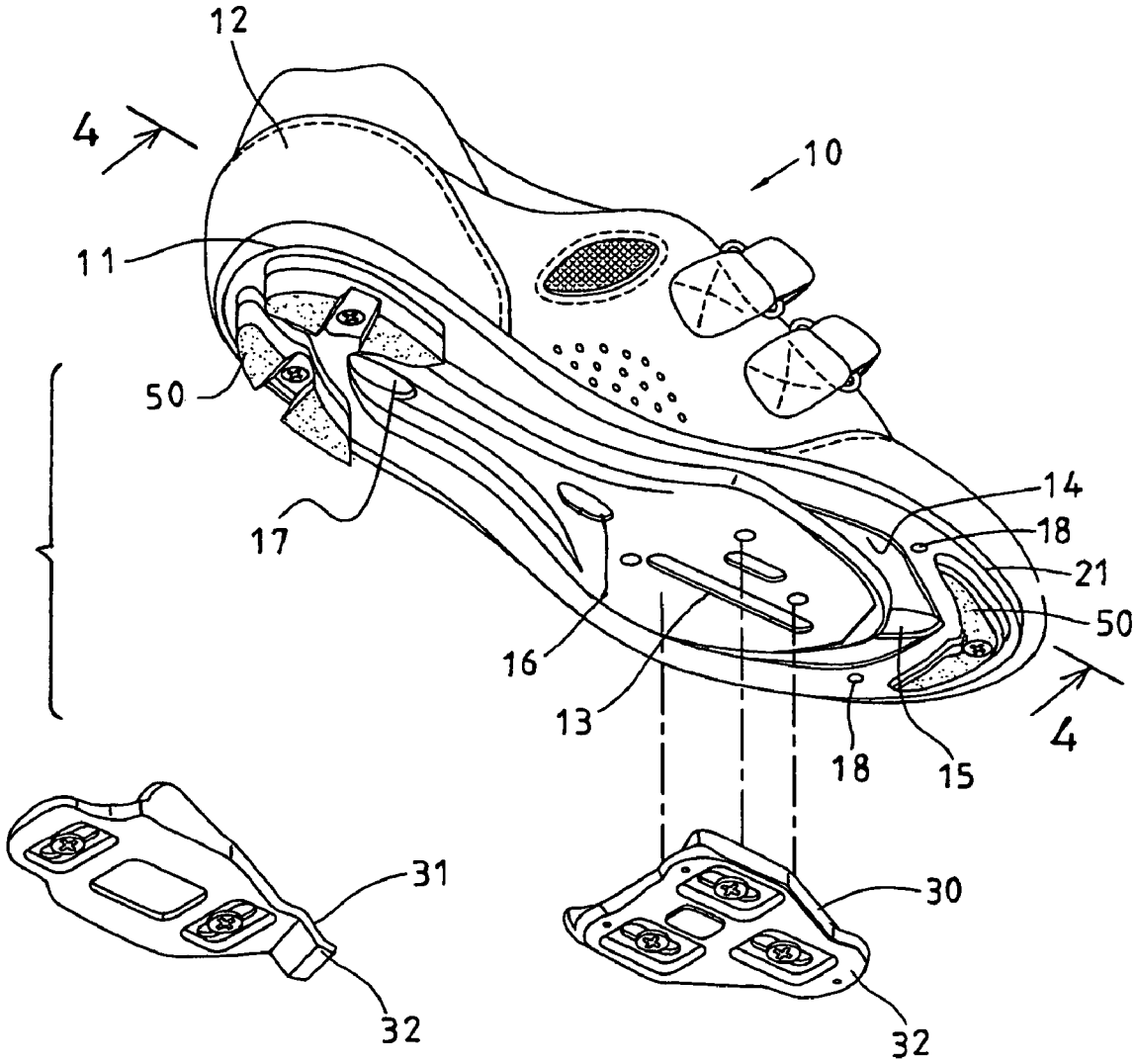
Figure 4:
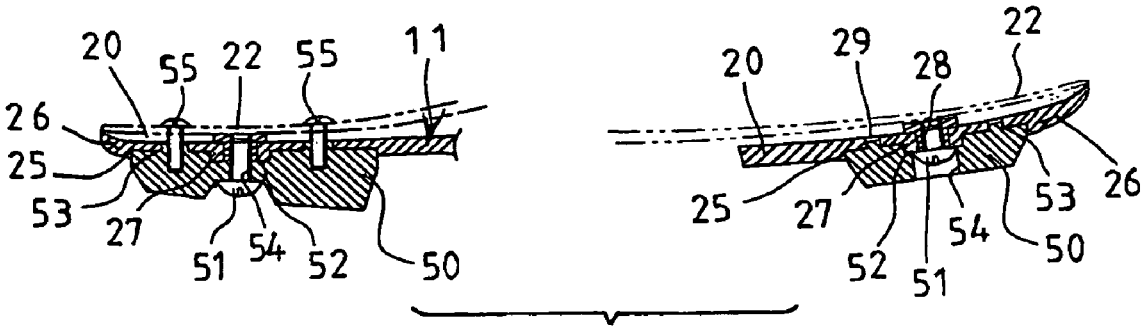
FIG. 4 is a partial cross sectional view taken along lines 4-4 of FIG. 3.

Referring to the drawings, and initially to FIGS. 1-3, a shoe attachment assembly in accordance with the present invention comprises a shoe 10 including a shoe sole 11 provided on bottom of a shoe upper 12. The shoe sole 11 includes one or more slots 13 formed in a middle portion thereof for selectively or changeably attaching either of the cleat members 30, 31 which may typically be detachably attached to cycle pedals 9 (FIGS. 1-3 and 6).

Figure 6:
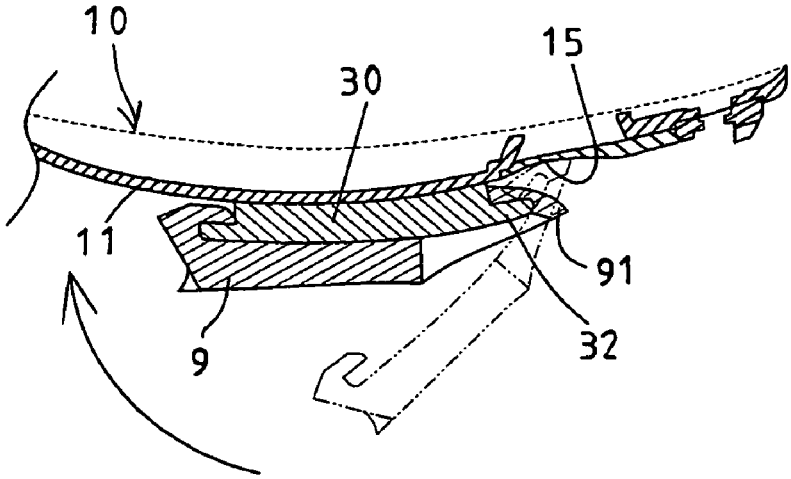
FIG. 6 is a partial cross sectional view illustrating the attaching of the shoe attachment assembly to a cycle pedal.

The shoe sole 11 further includes a depression 14 and a recess 15 formed in a middle portion thereof and located in front of the slots 13, for receiving a front portion 91 of the cycle pedal 9, as shown in FIG. 6, and for allowing a front extension 32 of the cleat members 30, 31 to be slightly rotated relative to the cycle pedals 9, and thus to be easily engaged into the front portion 91 of the cycle pedals 9.

Figure 13:
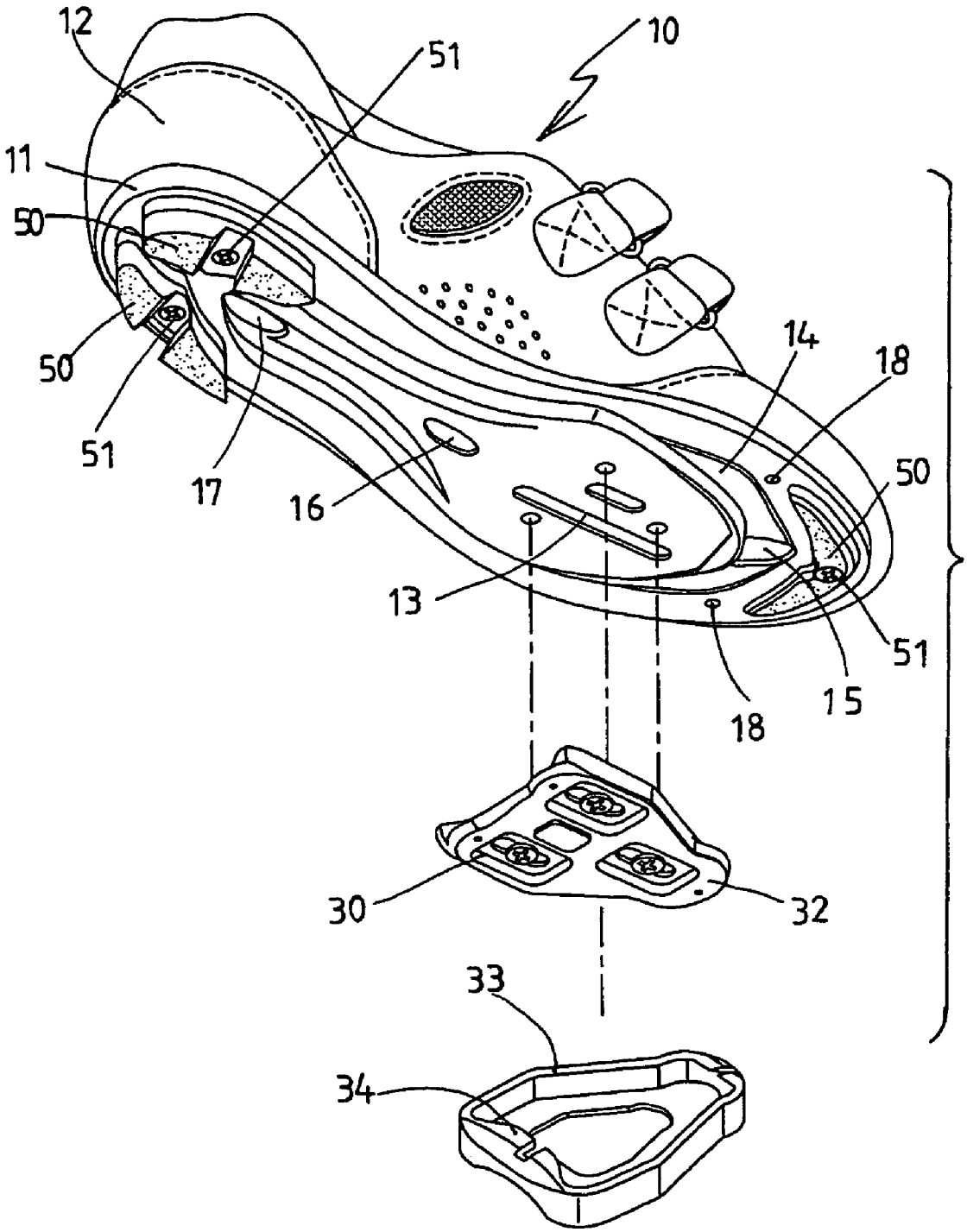
FIG. 13 is an exploded view illustrating a protective cap for a cleat member of the shoe attachment assembly.

As shown in FIG. 13, one or more protective caps 33 may further be provided and selectively attached onto the respective cleat members 30, 31. For example, each of the protective caps 33 includes a recess 34 formed therein to receive the respective cleat members 30, 31, and to attach or secure the protective caps 33 onto the respective cleat members 30, 31 with such as force-fitted engagements, to selectively protect the cleat members 30, 31.

Referring again to FIGS. 1-3, 7, 10 and 11, the shoe sole 11 further includes a number of orifices 16, 17 and holes 18 formed in the middle portion thereof and located in front of and/or behind the slots 13, for selectively attaching and securing either plates 40, 41, 42 to the bottom of the shoe sole 11 with fasteners 93 or spikes 94 (FIG. 1). One or more nuts 19 may be engaged in the holes 18 of the shoe sole 11 to thread with the fasteners 93 or the spikes 94.

Each of the plates 40-42 includes an opening 43 formed therein to receive the cleat members 30, 31, and to allow the cleat members 30, 31 to extend out of the plates 40-42, and to be attached to the cycle pedals 9. Each of the plates 40, 42 may further include one or more projections 44 extended downwardly therefrom (FIGS. 1, 2, 5, 7 and 10) for increasing frictional force, and for preventing the shoe sole 11 from wearing while walking on pavements and floors.

Alternatively, as shown in FIG. 1, the plate 41 may include a flat bottom surface having no projections extended downwardly therefrom, for providing the other purposes. For example, the plate 41 may be made of light weight and strong materials, such as nylon and fiber materials, and is provided to be attached to the shoe sole 11 that will be attached to the sports cycles.

Figure 5:
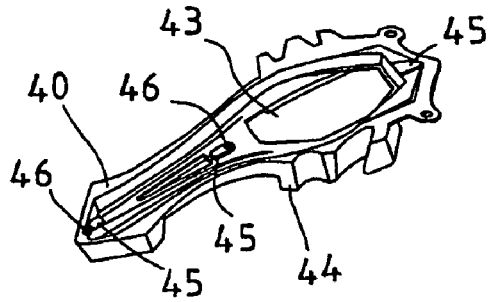
FIG. 5 is an upper perspective view showing one of the shoe attachments of the shoe attachment assembly.

As shown in FIG. 5, each of the plates 40, 42 may further include one or more protrusions 45 extended upwardly therefrom, to engage into the corresponding orifices 16, 17 and recesses 15 of the shoe sole 11, and to anchor and position the plates 40, 42 to the shoe sole 11, and to prevent the plates 40, 42 from being moved laterally relative to the shoe sole 11. Each of the protrusions 45 may include a screw hole 46 formed therein to thread with the fasteners 43.

Figure 12:
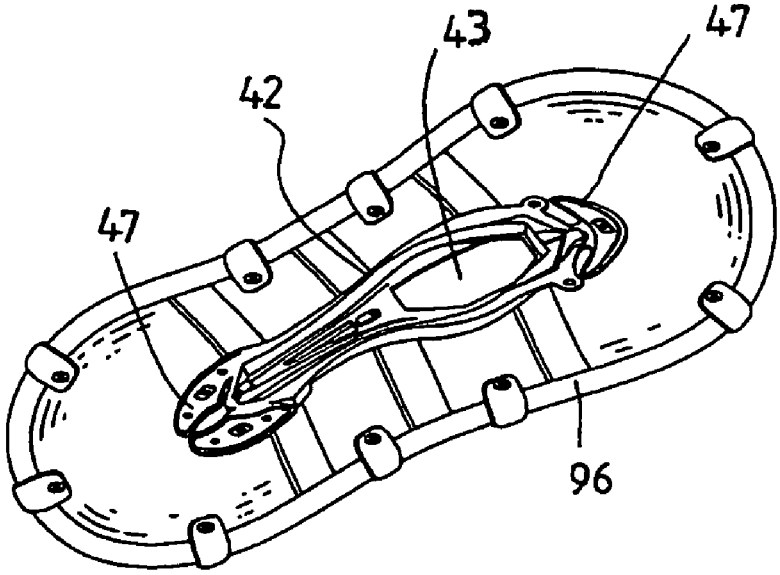
FIG. 12 is a top plan view illustrating a snow board of the shoe attachment assembly.
Figure 11:
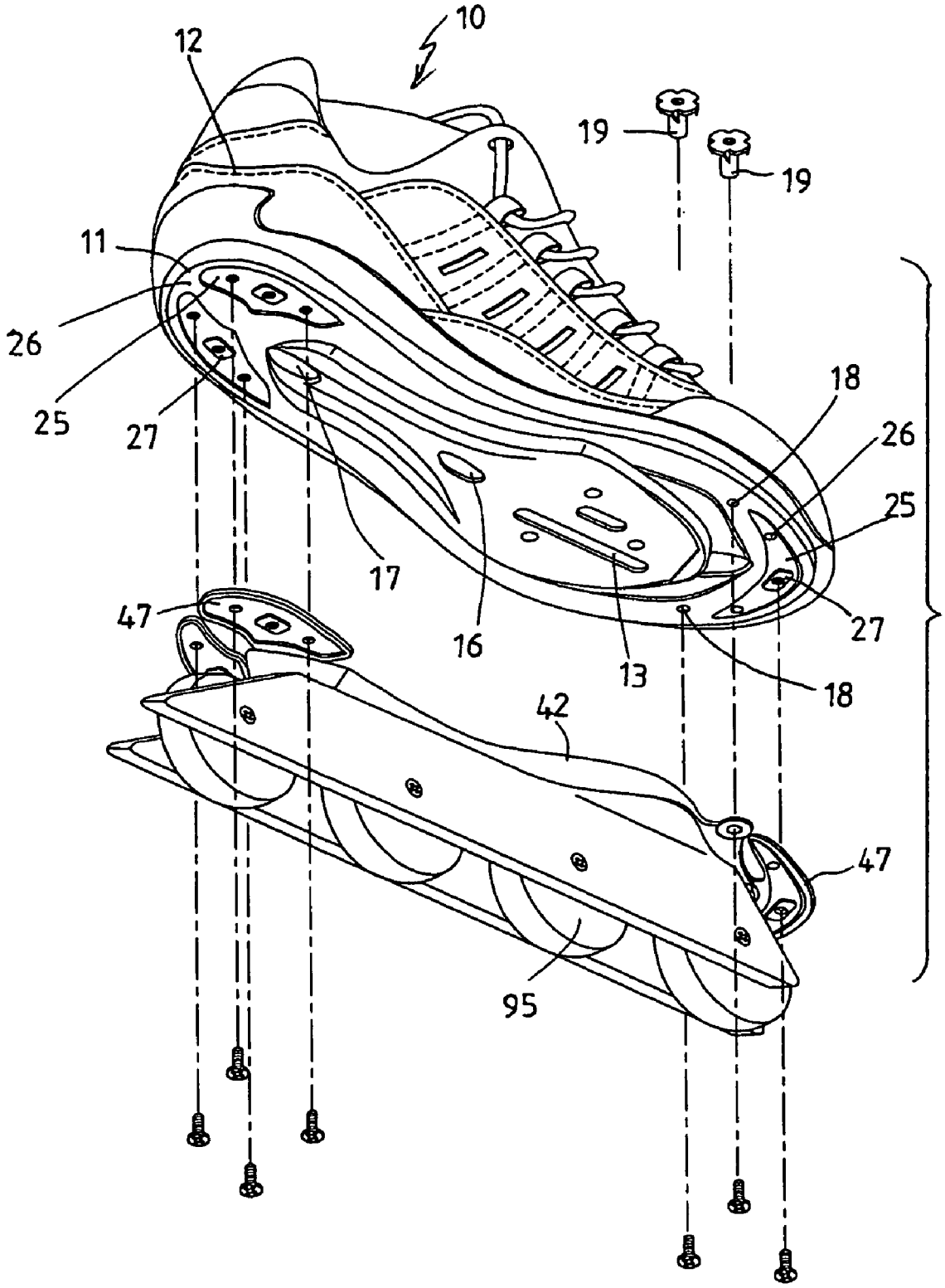

Referring next to FIGS. 11 and 12, the shoe attachment assembly may further include a plate 42 disposed on an in-line roller wheel device 95 (FIG. 11), or a ski or snow board 96 (FIG. 12), for allowing various kinds of objects, such as in-line roller skates 95, ski or snow boards 96 to be changeably or selectively attached to the shoe sole 11.

Figure 8:
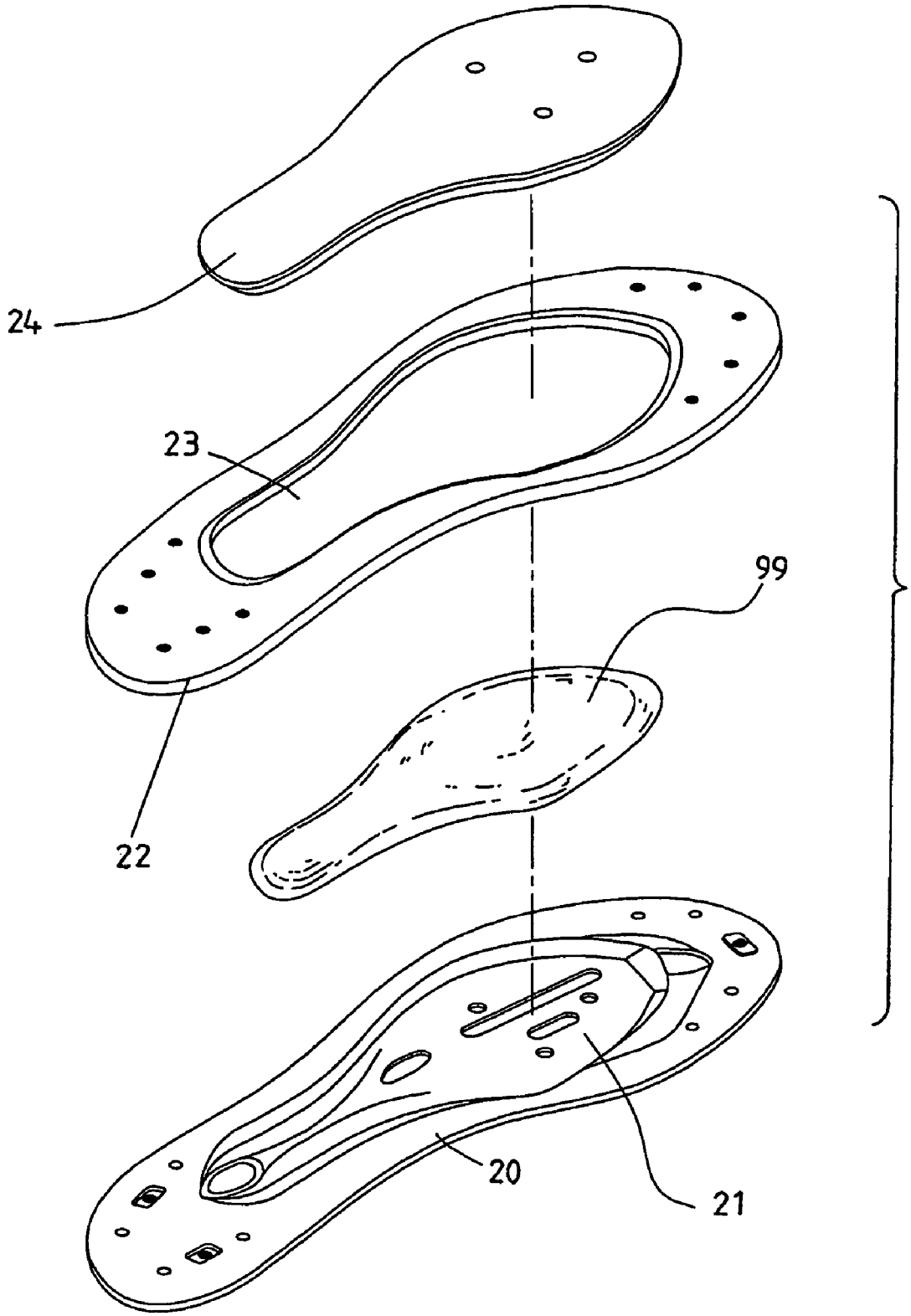
FIG. 8 is an exploded view illustrating the elements for the shoe sole of the shoe.
Figure 9:
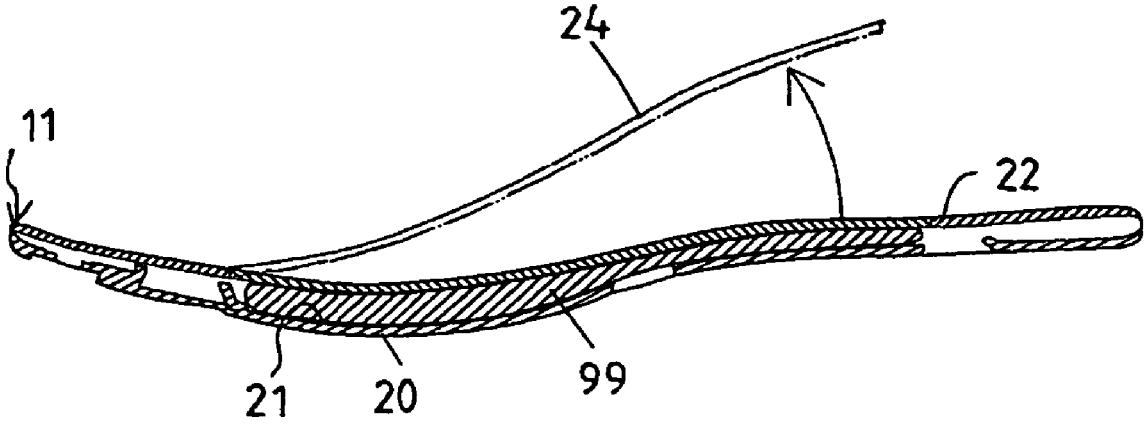
FIG. 9 is a partial cross sectional view illustrating the shoe sole of the shoe as shown in FIG. 8.

Referring next to FIGS. 8 and 9, the shoe sole 11 may include an outsole 20 having a chamber 21 formed therein to receive an cushioning device 99 therein, such as an envelope 99, which may provide a cushioning force against the shoe sole 11. An insole 22 may be attached onto the outsole 20 and may include an opening 23 formed therein to engage the cushioning device 99 into the chamber 21 of the out sole 20, and a cover 24 for openably enclosing the opening 23 of the insole 22.

Referring again to FIGS. 1-4, the shoe sole 11 further includes one or more depressions 25 formed in either the front or the rear portion thereof and each defined by a peripheral fence 26, to partially receive one or more cleat elements 50 therein which may be secured to the shoe sole 11 with fasteners 51. The shoe sole 11 further includes one or more bulges 27 extended into each of the depressions 25 thereof, and each having a screw hole 28 formed therein for threading with the fasteners 51.

Each of the cleat elements 50 includes one or more cavities 52 formed therein (FIG. 4), to receive the bulges 27 of the shoe sole 11, and to further anchor or secure the cleat elements 50 to the shoe sole 11. The shoe sole 11 further includes one or more apertures 29 formed therein, and each of the cleat elements 50 further includes one or more pegs 53 extended therefrom and engaged into the apertures 29 of the shoe sole 11, to further anchor or secure the cleat elements 50 to the shoe sole 11.

Each of the cleat elements 50 may further include a depression 54 formed therein to receive the fasteners 51, and to prevent the fasteners 51 from being extended out of the cleat elements 50. One or more fasteners 55 may further be provided and engaged through the insole 22 and the outsole 20 of the shoe sole 11 and engaged into the pegs 53, to further solidly secure the cleat elements 50 to the shoe sole 11.

Figure 10:
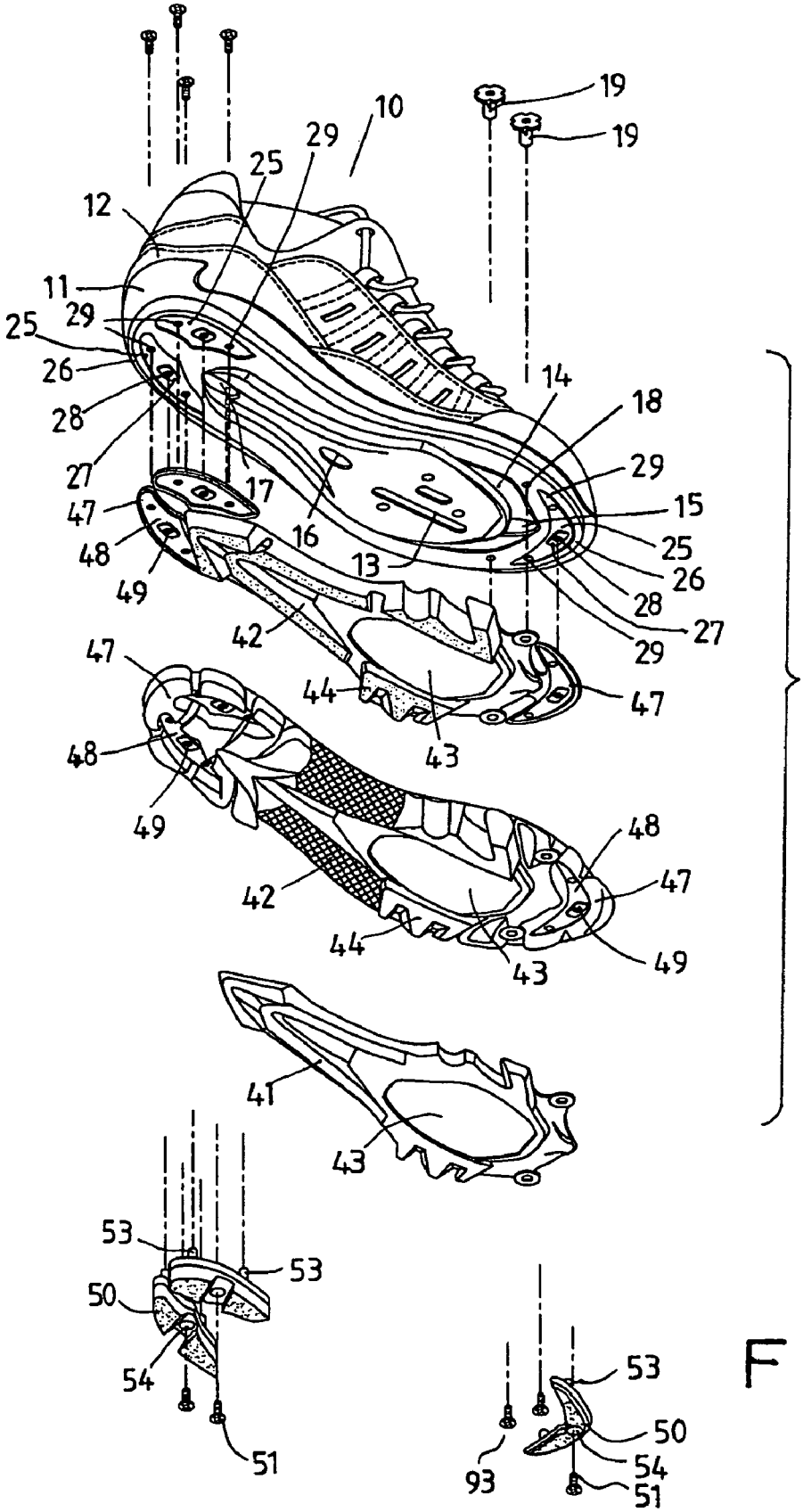
FIGS. 10, 11 are exploded views illustrating the other applications of the shoe attachment assembly.

It is to be noted that the shoe upper 12 of the shoe may include different types of structures, such as the sports shoe upper 12 as shown in FIGS. 1-3 and 7, or the typical leisure shoe upper 12 as shown in FIGS. 10 and 11.

Figure 7:
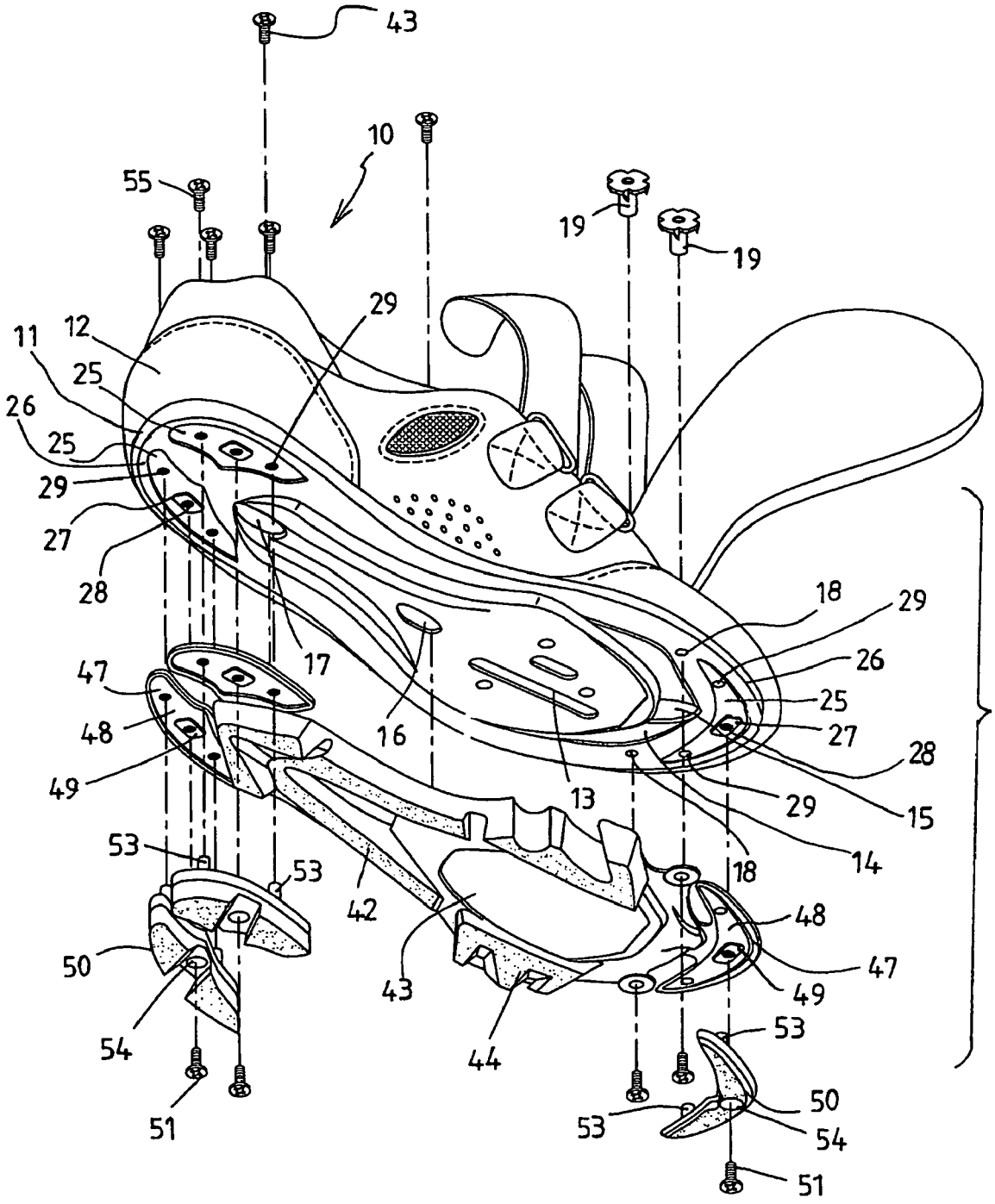
FIG. 7 is an exploded view illustrating the other embodiment of the shoe attachment assembly.

As shown in FIGS. 7 and 10, each of the plates 42 may include an extension 47 extended from either the front or the rear portion thereof, and each of the extensions 47 may include one or more depressions 48 formed therein and each defined by a peripheral fence, to partially receive the cleat elements 50 therein respectively, and to allow the cleat elements 50 to be indirectly attached to the shoe sole 11 via the plates 42.

In operation, as shown in FIG. 3, the cleat members 30, 31 may be attached to the shoe sole 11, for detachably attaching or securing to the cycle pedals 9 (FIG. 6), and for allowing the riders to easily ride the sports cycles or bikes. As shown in FIGS. 1, 2, 7 and 10, the plates 40-42 and/or the cleat elements 50 may be selectively attached to the shoe sole 11, for increasing frictional force, and for preventing the shoe sole 11 from wearing while walking on pavements and floors, and thus for allowing the riders to easily ride the mountain cycles or bikes and to walk or to climb the mountains.

Accordingly, the shoe attachment assembly in accordance with the present invention includes a shoe attachment assembly for attaching to various cycles, including such as mountain cycles or bikes, or sports cycles or bikes, or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A shoe comprising:

a shoe sole including at least one slot formed therein, and including at least one orifice formed therein, a first cleat member detachably attached to said at least one slot of said shoe sole, and including an extension extended therefrom for attaching to a cycle pedal, and a first plate selectively attached to said shoe sole, and including an opening formed therein to receive said first cleat member, and to allow said first cleat member to extend out of said first plate, and to be attached to the cycle pedal, said first plate including at least one protrusion extended therefrom and engageable into said at least one orifice of said shoe sole to anchor said first plate to said shoe sole, said first plate including at least one projection extended downwardly therefrom for preventing said shoe sole from wearing, a second plate selectively attached to said shoe sole when said first plate is disengaged from said shoe sole, and including an opening formed therein to selectively receive said first cleat member, and to allow said first cleat member to extend out of said second plate, and to be attached to the cycle pedal, said second plate including at least one protrusion extended therefrom and engageable into said at least one orifice of said shoe sole to selectively anchor said second plate to said shoe sole, and at least one cleat element detachably attached to said shoe sole.

2. The shoe as claimed in claim 1 further comprising at least one spike securing either said first plate or said second plate to said shoe sole.

3. The shoe as claimed in claim 1, wherein said shoe sole includes at least one depression formed therein and defined by a peripheral fence, to partially receive said at least one cleat element, and to anchor said at least one cleat element to said shoe sole.

4. The shoe as claimed in claim 3, wherein said shoe sole includes a bulge extended into said at least one depression thereof, and said at least one cleat element includes a cavity formed therein, to receive said bulge of said shoe sole, and to further anchor said at least one cleat element to said shoe sole.

5. The shoe as claimed in claim 3, wherein said shoe sole includes at least one aperture formed therein, and said at least one cleat element includes at least one peg extended therefrom, to engage into said at least one aperture of said shoe sole, and to further anchor said at least one cleat element to said shoe sole.

6. The shoe as claimed in claim 1, wherein said second plate includes at least one extension extended therefrom, said at least one cleat element is selectively attachable to said at least one extension of said second plate.

7. The shoe as claimed in claim 6, wherein said at least one extension of said second plate includes at least one depression formed therein and defined by a peripheral fence, to partially receive said at least one cleat element, and to anchor said at least one cleat element to said at least one extension of said second plate.

8. The shoe as claimed in claim 6, wherein said at least one extension of said second plate includes a bulge extended into said at least one depression thereof, and said at least one cleat element includes a cavity formed therein, to receive said bulge of said at least one extension of said second plate, and to anchor said at least one cleat element to said second plate.

9. The shoe as claimed in claim 1, wherein said shoe sole includes an outsole, and insole, and a cushioning device disposed between said outsole and said insole of said shoe sole.

10. The shoe as claimed in claim 9, wherein said outsole of said shoe sole includes a chamber formed therein to receive said cushioning device.

11. The shoe as claimed in claim 10, wherein said insole includes an opening formed therein to engage said cushioning device into said chamber of said outsole.

12. The shoe as claimed in claim 11, wherein said insole includes a cover to enclose said opening of said insole.

13. The shoe as claimed in claim 1, wherein said shoe sole further includes at least one nut engaged therein, and at least one fastener engaged through said plate and threaded to said at least one nut.

* * * * *